US009840952B2

(12) United States Patent
Sugiura et al.

(10) Patent No.: US 9,840,952 B2
(45) Date of Patent: Dec. 12, 2017

(54) BREATHER CHAMBER OF INTERNAL COMBUSTION ENGINE

(71) Applicant: HONDA MOTOR CO., LTD., Tokyo (JP)

(72) Inventors: Hiroyuki Sugiura, Wako (JP); Hiroshi Yokota, Wako (JP); Noriyuki Suzuki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 105 days.

(21) Appl. No.: 14/858,473

(22) Filed: Sep. 18, 2015

(65) Prior Publication Data

US 2016/0090880 A1 Mar. 31, 2016

(30) Foreign Application Priority Data

Sep. 29, 2014 (JP) ..... 2014-198375

(51) Int. Cl.

| | |
|---|---|
| ***F02B 25/06*** | (2006.01) |
| ***F01M 13/04*** | (2006.01) |
| ***F01L 1/02*** | (2006.01) |
| ***F01L 1/047*** | (2006.01) |
| ***F02F 1/24*** | (2006.01) |
| ***F02F 7/00*** | (2006.01) |

(52) U.S. Cl.

CPC ..... *F01M 13/04* (2013.01); *F01L 1/022* (2013.01); *F01L 1/047* (2013.01); *F01M 13/0405* (2013.01); *F02F 1/24* (2013.01); *F02F 7/0043* (2013.01); *F01M 2013/0461* (2013.01)

(58) Field of Classification Search

CPC ..... F01M 13/04; F01M 13/0405; F01M 2013/0461; F02F 7/0043; F02F 1/24; F01L 1/047; F01L 1/022

USPC ..... 123/572–574, 41.86, 54.4–54.8

See application file for complete search history.

(56) References Cited

U.S. PATENT DOCUMENTS

| | | | | |
|---|---|---|---|---|
| 5,881,686 A * | 3/1999 | Schmidt | F01M 13/023 | 123/41.86 |
| 6,439,185 B2 * | 8/2002 | Tosaka | F01L 1/024 | 123/54.4 |
| 2002/0017283 A1 * | 2/2002 | Furuya | F01M 13/022 | 123/573 |
| 2002/0195091 A1 | 12/2002 | Baek | | |

(Continued)

FOREIGN PATENT DOCUMENTS

| | | |
|---|---|---|
| JP | 2008-19794 A | 1/2008 |
| JP | 2008-248806 A | 10/2008 |
| JP | 2013-130080 A | 7/2013 |

*Primary Examiner* — Marguerite McMahon

(74) *Attorney, Agent, or Firm* — Birch, Stewart, Kolasch & Birch, LLP

(57) ABSTRACT

A breather chamber for an internal combustion engine wherein the breather chamber has a large size that is formed while an increase in the size of the internal combustion engine is suppressed. The breather chamber of an internal combustion engine includes looped cam chains for transmitting the power of a horizontally disposed crankshaft to camshafts provided in cylinder heads and includes cam chain chambers disposed alongside portions of cylinder block portions which intersect the direction of the crankshaft. The breather chamber is located on a side of a plane formed by a rotation locus of the cam chain in the direction of the crankshaft in the cam chain chamber.

8 Claims, 5 Drawing Sheets

(56) References Cited

U.S. PATENT DOCUMENTS

| | | | | |
|---|---|---|---|---|
| 2003/0070661 | A1* | 4/2003 | Yasui | F01M 13/04<br>123/572 |
| 2012/0080015 | A1* | 4/2012 | Matsushima | F01M 13/04<br>123/573 |

* cited by examiner

BREATHER CHAMBER OF INTERNAL COMBUSTION ENGINE

CROSS-REFERENCE TO RELATED APPLICATIONS

The present application claims priority under 35 USC 119 to Japanese Patent Application No. 2014-198375 filed Sep. 29, 2014 the entire contents of which are hereby incorporated by reference.

BACKGROUND OF THE INVENTION

1. Field of the Invention

The present invention relates to a breather chamber of an internal combustion engine for suppressing an increase in the size of the internal combustion engine.

2. Description of Background Art

Some internal combustion engines including a cam chain chamber disposed along a side portion of a cylinder block portion which intersects the direction of a crankshaft and includes a looped cam chain for transmitting the power of the crankshaft to a camshaft provided in a cylinder head having a structure in which a breather chamber is provided outside a rotation locus of the cam chain. See, for example, Japanese Patent Application Publication No. 2008-248806 (FIGS. 1 to 4).

However, in the structure disclosed in Japanese Patent Application Publication No. 2008-248806, the breather chamber bulges outside the cam chain. Accordingly, the size of the cam chain chamber increases. Therefore the size of the internal combustion engine may increase.

SUMMARY AND OBJECTS OF THE INVENTION

An object of an embodiment of the present invention is to provide a breather chamber of an internal combustion engine which includes a looped cam chain for transmitting the power of a crankshaft to a camshaft provided in a cylinder head and includes a cam chain chamber disposed along a side portion of a cylinder block portion intersecting the direction of the crankshaft. Thus, the breather chamber having a large size can be formed while an increase in the size of the internal combustion engine is suppressed.

To solve the above-described problem, according to an embodiment of the present invention, a breather chamber of an internal combustion engine includes a looped cam chain for transmitting power of a horizontally disposed crankshaft to a camshaft provided in a cylinder head with a cam chain chamber disposed along a side portion of a cylinder block portion and the side portion intersecting a direction of the crankshaft. The breather chamber is located on a side of a plane formed by a rotation locus of the cam chain in the direction of the crankshaft in the cam chain chamber.

According to an embodiment of the present invention, the cam chain chamber is formed by attaching a cam chain chamber cover to the side portion of the cylinder block portion. In addition, a partitioning member for dividing the breather chamber from the cam chain chamber is formed of a flat plate and attached to an inside of the cam chain chamber cover.

According to an embodiment of the present invention, the breather chamber has an inlet provided in a lower portion of the cam chain chamber and an outlet provided in an upper portion of the cam chain chamber.

According to an embodiment of the present invention, a rib protruding from the cam chain chamber cover into the breather chamber is formed downwardly along an inner surface of the cam chain chamber cover between the inlet and the outlet.

According to an embodiment of the present invention, the internal combustion engine is an in-vehicle engine, the crankshaft is directed in a longitudinal direction of a vehicle, the cam chain chamber is disposed on a front surface of the internal combustion engine, and a front portion of the cam chain chamber is divided to form the breather chamber.

In the breather chamber of the internal combustion engine, according to an embodiment of the present invention, since a large-area space located on the side of the plane formed by the rotation locus of the cam chain in the direction of the crankshaft is utilized to provide the breather chamber, the breather chamber having a large size can be formed while an increase in the size of the internal combustion engine is suppressed.

According to an embodiment of the present invention, with a simple configuration, the breather chamber can be formed between the cam chain chamber cover and the partitioning member, and the cam chain chamber in which oil is scattered can be divided from the breather chamber. Further, since the partitioning member is formed of a flat plate, an increase in the size of the internal combustion engine with respect to the direction of the crankshaft can be suppressed.

According to an embodiment of the present invention, a layout which allows oil to be easily discharged from the breather chamber can be obtained using the vertical height of the cam chain chamber.

According to an embodiment of the present invention, oil separated from the breather gas to adhere to the rib is caused to flow downwardly, and oil is easily discharged from the breather chamber.

According to an embodiment of the present invention, even in the case where the internal combustion engine with the crankshaft directed in the longitudinal direction of a vehicle is mounted on a vehicle having space limitations with respect to the longitudinal direction thereof, partitioning a front-side space of the cam chain chamber with respect to the direction of the crankshaft suppresses an increase in the size of the internal combustion engine with respect to the longitudinal direction of the vehicle while achieving a large volume of the breather chamber, and facilitates the installation of the internal combustion engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
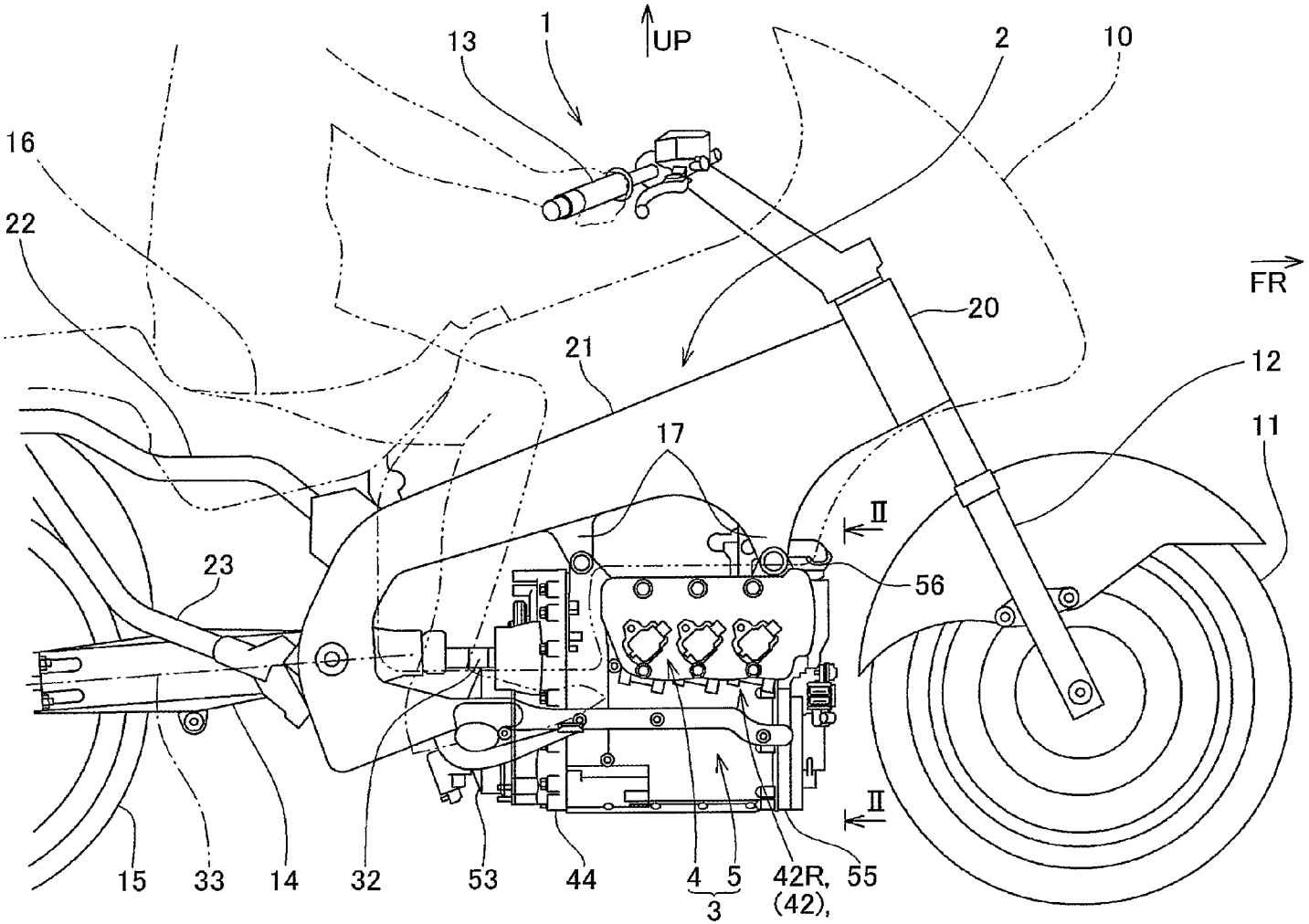
FIG. 1 is a right side view of a principal part of a motorcycle including a power unit in which a breather chamber of an internal combustion engine according to one embodiment of the present invention is provided.

A breather chamber of an internal combustion engine according to one embodiment of the present invention will be described with reference to FIGS. 1 to 5.

In the appended claims and this specification, directions such as front, rear, left, right, upward, and downward directions are based on the orientation of a vehicle including a power unit in which the breather chamber the internal combustion engine of the present embodiment is provided. In the present embodiment, a vehicle is a saddle-type vehicle such as a motorcycle.

In the drawings, arrows FR, LH, RH, and UP indicate front, left, right, and upward directions, respectively.

FIG. 1 is a right side view of a principal part of a motorcycle 1 including a power unit 3 in which a breather chamber 7 of an internal combustion engine 4 according to one embodiment of the present invention is provided. In the motorcycle 1 of FIG. 1, a body cover 10 is indicated by a two-dot chain line in a simplified manner, part of which is omitted, and only a principal part is shown with an intake system, an exhaust system, a fuel system, and the like being omitted.

A body frame 2 of the motorcycle 1 includes a head pipe 20 by which a front fork 12 pivotally supporting a front wheel 11 is movably supported so that steering can be performed, a main frame 21 extending from the head pipe 20 and downward sloping toward the back, seat rails 22 extending from upper portions of rear ends of the main frame 21 and upward sloping toward the back, and a back stay 23 connecting lower portions of rear ends of the main frame 21 and rear-side portions of the seat rails 22.

A steering handle 13 is connected to an upper portion of the front fork 12. Moreover, a front end portion of a swing arm 14 is movably supported by rear end portions of the main frame 21 to be vertically swingable with a rear drive wheel 15 being pivotally supported by a rear end portion of the swing arm 14.

Further, an unillustrated rear shock absorber is provided between the upper portions of the rear ends of the main frame 21 and the swing arm 14, and a riding seat 16 is attached to upper portions of the seat rails 22.

A power unit 3 for driving the rear wheel 15 is disposed in a space below the main frame 21. The power unit 3 is supported by the main frame 21 with a plurality of hanger members 17 interposed therebetween. An output shaft 32 of the power unit 3 is connected to the rear wheel 15 through a drive shaft 33 installed along the swing arm 14 for transmitting rotational power to the rear wheel 15.

Figure 2:
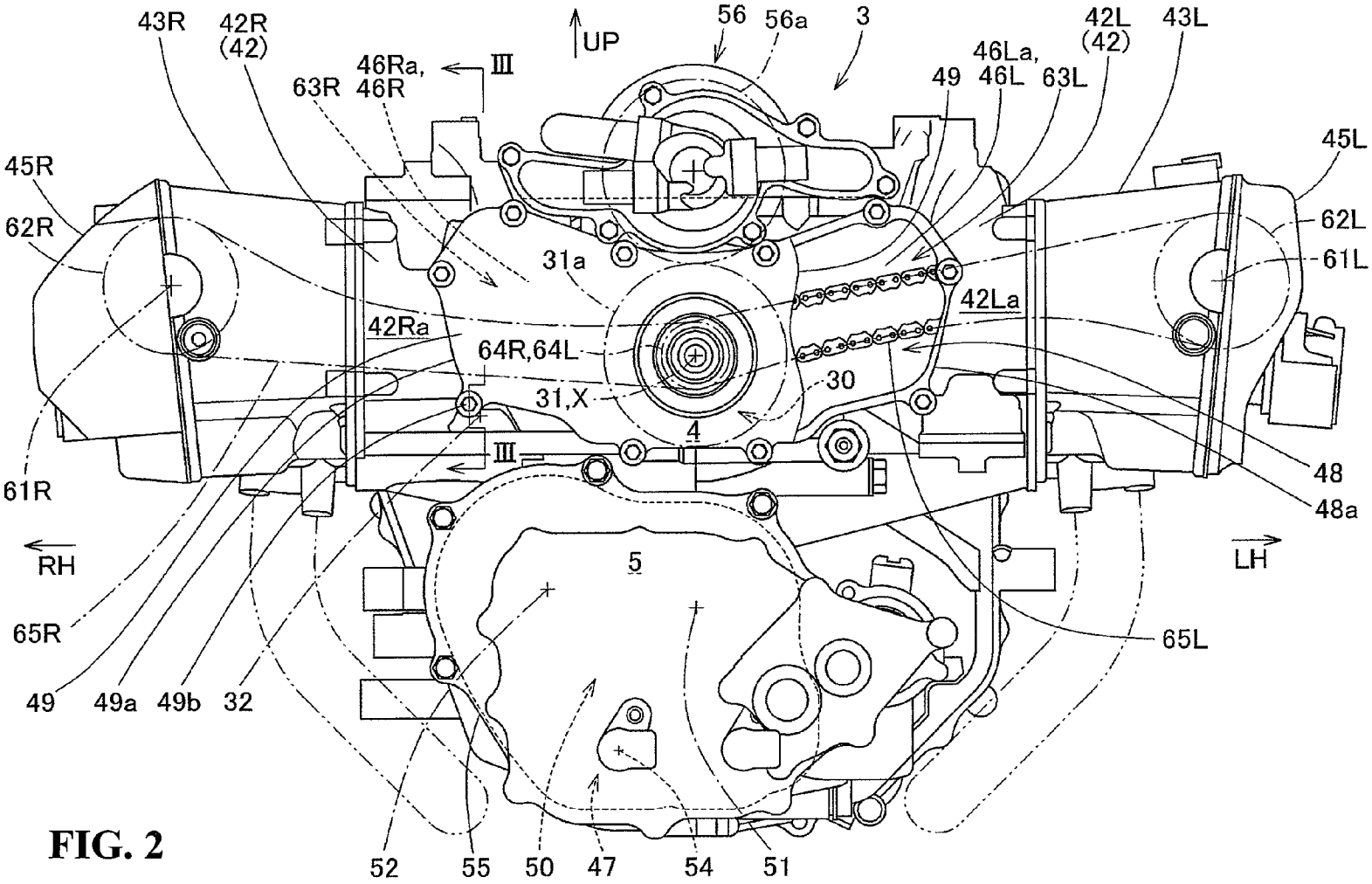
FIG. 2 is a front view of the power unit as seen from arrows II-II of FIG. 1.

FIG. 2 is a front view of the power unit 3 as seen from arrows II-II of FIG. 1.

As shown in FIGS. 1 and 2, the power unit 3 includes the water-cooled, horizontally-opposed, six-cylinder, four-stroke internal combustion engine 4, and a transmission 5 which changes the speed of the rotational power of the internal combustion engine 4 and which is provided with a reverse transmission system for reversing the direction of rotation.

A shell of the internal combustion engine 4 includes a crankcase 42, which includes a left crankcase 42L disposed on a left side as seen in the front direction of travel of the motorcycle 1 and a right crankcase 42R disposed on a right side as seen in the front direction of travel thereof; left and right cylinder heads 43L and 43R respectively connected to outer ends of left and right crankcases 42L and 42R and a rear cover 44 connected to the left and right crankcases 42L and 42R (see FIG. 1).

The rear cover 44 is connected to the left and right crankcases 42L and 42R to close rear portions of the left and right crankcases 42L and 42R disposed along the direction of travel of the motorcycle 1.

It should be noted that left and right cylinder head covers 45L and 45R are respectively fastened to outer ends of the left and right cylinder heads 43L and 43R to cover left and right valve trains provided in the left and right cylinder heads 43L and 43R and driven sprockets 62L and 62R of camshafts 61L and 61R thereof.

The left and right crankcases 42L and 42R are fastened to each other to form the crankcase 42 wherein a crankshaft 31 horizontally disposed with an axis X thereof directed in the longitudinal direction of the motorcycle 1 is rotatably supported at mating surfaces of the left and right crankcases 42L and 42R to demarcate a crank chamber 30 around the crankshaft 31.

Further, the left and right crankcases 42L and 42R have left and right cylinder block portions 46L and 46R incorporated therein on left and right sides of the crank chamber 30, respectively. Each of the left and right cylinder block portions 46L and 46R has three parallel cylinder bores 46*a* (see FIG. 3) formed therein through which unillustrated pistons connected to the crankshaft 31 through unillustrated connecting rods in common are inserted.

In the left and right crankcases 42L and 42R, below the crank chamber 30, a main shaft 51 and a counter shaft 52 of the transmission 5 which are disposed parallel to the crankshaft 31 and directed in the longitudinal direction of the vehicle are supported, and a transmission chamber 50 is demarcated. In the left and right crankcases 42L and 42R, further below the transmission chamber 50, an oil pan portion 47 is formed.

A clutch cover 53 disposed concentrically with the main shaft 51 of the transmission 5 to cover an unillustrated clutch mechanism is attached to a rear surface of the rear cover 44, and the output shaft 32 of the power unit 3 protrudes from the rear cover 44 toward the rear (see FIG. 1).

The output shaft 32 is connected to the drive shaft 33 (see FIG. 1), which extends along the swing arm 14 and is connected to the rear wheel 15, and transmits the rotational power of the internal combustion engine 4 to the rear wheel 15.

As shown in FIG. 2, a cam chain chamber opening 48 is provided to straddle left and right crankcase front walls 42La and 42Ra, which are front portions of the left and right crankcases 42L and 42R fastened to each other, and to be located from a region around the crankshaft 31 to regions near the left and right cylinder heads 43L and 43R.

An opening circumferential wall 48*a* protruding toward the front is formed on a circumferential edge of the cam chain chamber opening 48. A cam chain chamber cover 49 is fastened to the opening circumferential wall 48*a* with fastening bolts 49*b*. Thus, the cam chain chamber cover 49 closes the cam chain chamber opening 48 to close a front portion of the crank chamber 30.

Moreover, a transmission holder 55 is provided around the main shaft 51 and the counter shaft 52 of the transmission 5, which is disposed below the crankshaft 31, with a shift drum 54, and the like (the positions of the central axes thereof are shown in FIG. 2), to be connected to the left and right crankcases 42L and 42R and to close a front portion of the transmission chamber 50.

The transmission chamber 50 is formed from the transmission holder 55 to the insides of the left and right crankcases 42L and 42R, and houses the transmission 5.

The left and right crankcases 42L and 42R have left and right cam chain chambers 63L and 63R demarcated therein along front-side (on a front side in FIG. 2) side portions of the respective cylinder block portions 46L and 46R with respect to the direction of the crankshaft 31 to communicate with insides of the left and right cylinder heads 43L and 43R. The cam chain chamber cover 49, together with the left and right crankcase front walls 42La and 42Ra, constitutes part of a front wall which covers the left and right cam chain chambers 63L and 63R.

It should be noted that in FIG. 2, the cam chain chamber cover 49 is shown with part of a left-side portion (right-side portion in the drawing) being cut away. A front side portion ("side portion" in the present invention) 46La of the left cylinder block portion 46L and the left cam chain chamber 63L located ahead of the front side portion 46La in the drawing are shown behind the cut-away portion in the drawing. Part of a left cam chain 65L extending in the cam chain chamber 63L is shown in FIG. 2.

Similarly, a front side portion ("side portion" in the present invention) 46Ra of the right cylinder block portion 46R, a right cam chain chamber 63R, and a right cam chain 65R are disposed behind a right-side portion (left-side portion in the drawing) of the cam chain chamber cover 49.

The cam chain 65L for transmitting the power of the crankshaft 31 to the left camshaft 61L is passed through the left cam chain chamber 63L and looped around a drive sprocket 64L for the left camshaft 61L fitted to a front-end side of the crankshaft 31 and the driven sprocket 62L of the camshaft 61L of the left valve train provided in the left cylinder head 43L.

Moreover, the cam chain 65R for transmitting the power of the crankshaft 31 to the right camshaft 61R is passed through the right cam chain chamber 63R and looped around a drive sprocket 64R for the right camshaft 61R fitted to the front-end side of the crankshaft 31 and the driven sprocket 62R of the camshaft 61R of the right valve train provided in the right cylinder head 43R.

These components drive the left and right valve trains. An inlet valve and an exhaust valve, both unillustrated, corresponding to each of the cylinder bores 46*a* (see FIG. 3) are opened and closed with a predetermined timing in synchronization with the rotation of the crankshaft 31.

It should be noted that a water pump drive gear 31*a* is also fitted to the front-end side of the crankshaft 31 to mesh with a driven gear 56*a* of a water pump 56.

More specifically, as shown in FIG. 2, in the left and right crankcases 42L and 42R, the left and right cam chain chambers 63L and 63R are demarcated which are covered by the left and right crankcase front walls 42La and 42Ra along the front side portions 46La and 46Ra of the respective cylinder block portions 46L and 46R intersecting the direction of the crankshaft 31. The left and right crankcase front walls 42La and 42Ra have the cam chain chamber opening 48 which straddles both the left and right crankcase front walls 42La and 42Ra to include a region around the crankshaft 31. The cam chain chamber cover 49 is fastened to the opening circumferential wall 48*a*, which protrudes from the circumferential edge of the cam chain chamber opening 48 to the front, to cover the left and right cam chain chambers 63L and 63R.

Figure 3:
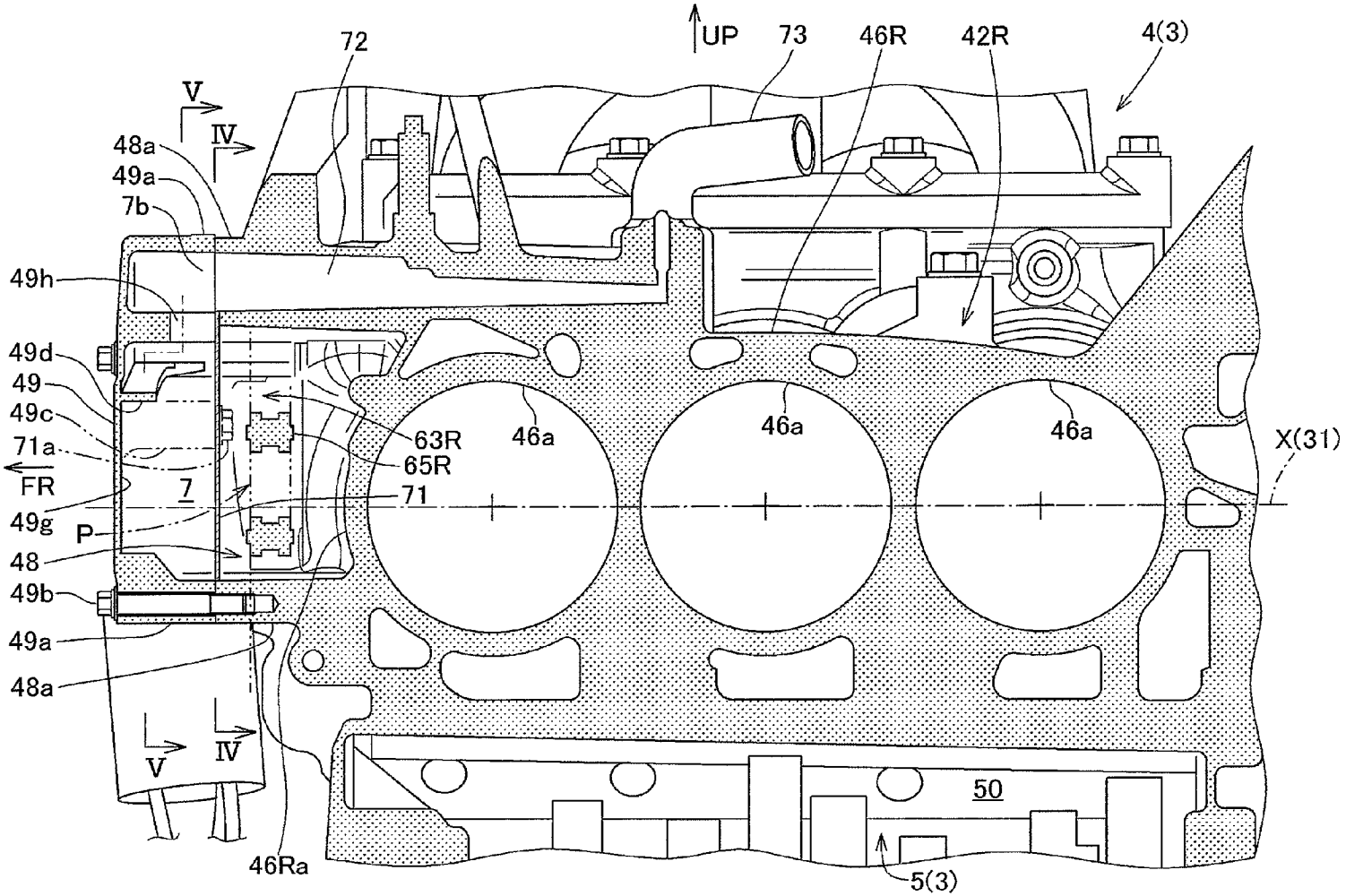
FIG. 3 is a vertical cross-sectional view of a principal part of a front portion of the power unit taken in the direction of a crankshaft as seen from arrows III-III of FIGS. 2, 4, and 5.
Figure 4:
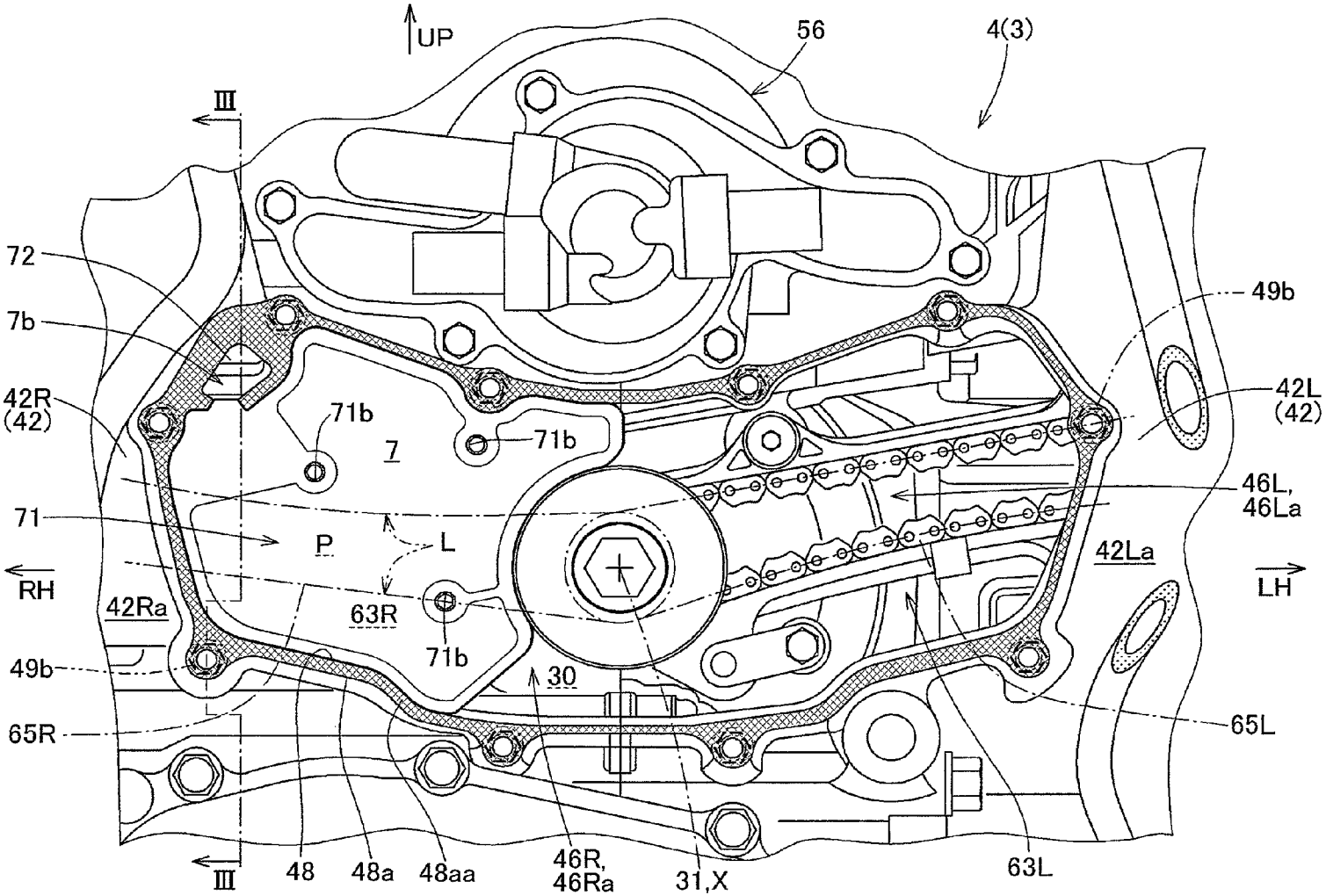
FIG. 4 is a front view of a portion around an opening of the cam chain chamber with a cam chain chamber cover of FIG. 2 removed, a partitioning member being shown at a predetermined position, as seen from arrows IV-IV of FIG. 3.

As shown in FIG. 3 showing a vertical cross section of a principal part of a front portion of the power unit 3 taken along the axis X of the crankshaft 31 as seen from arrows of FIG. 2, an outer circumferential edge of the cam chain chamber cover 49 also has a cover circumferential wall 49*a* protruding to the rear, and the cover circumferential wall 49*a* is fastened to the opening circumferential wall 48*a* with cover fastening bolts 49*b* (also see FIG. 4).

Accordingly, portions of the left and right cam chain chambers 63L and 63R which are covered with the cam chain chamber cover 49 have spaces larger than those of portions thereof covered with the left and right crankcase front walls 42La and 42Ra by an amount equal to an inside height of the cam chain chamber cover 49, i.e., an amount approximately equal to the height of the cover circumferential wall 49*a* in the direction of the axis X of the crankshaft.

Accordingly, as shown in FIG. 3, in the present embodiment, in the cam chain chamber 63R on the right crankcase 42R side, a partitioning member 71 formed of a flat plate is disposed on the front side of a plane P formed by a rotation locus L (see FIG. 4) of the cam chain 65R in the direction of the crankshaft 31. Thus, the breather chamber 7 is demarcated between the partitioning member 71 and an inner surface (rear surface) 49*g* of the cam chain chamber cover 49 to be divided from the cam chain chamber 63R.

More specifically, a portion of the cam chain chamber 63R which is covered with the cam chain chamber cover 49 is formed by fastening the cam chain chamber cover 49 to the opening circumferential wall 48*a* of the cam chain chamber opening 48. Since the cam chain chamber cover 49 having the partitioning member 71 attached to the inside (rear side) thereof is fastened, the breather chamber 7 is formed on the front side of the plane P formed by the rotation locus L of the right cam chain 65R in the direction of the crankshaft 31 to be divided from the right cam chain chamber 63R.

Accordingly, since a large-area space in the cam chain chamber opening 48 which is located on the front side of the plane P formed by the rotation locus L of the right cam chain 65P in the direction of the crankshaft 31 is utilized to provide the breather chamber 7, a breather chamber 7 having a large size is formed while an increase in the size of the internal combustion engine 4 is suppressed.

More particularly, even in the case where the internal combustion engine 4 of the power unit 3 is an in-vehicle engine which has the crankshaft 31 directed in the longitudinal direction of the vehicle and which is mounted on a vehicle having space limitations with respect to the longitudinal direction, disposing the cam chain chambers 63L and 63R on front surfaces of the crankcases 42L and 42R of the internal combustion engine 4 and forming the breather chamber 7 in the front portion of the cam chain chamber 63R by dividing a front-side space of the right cam chain chamber 63R suppresses an increase in the size of the internal combustion engine 4 with respect to the longitudinal direction of the vehicle while achieving a large volume of the breather chamber 7, and facilitates the installation of the internal combustion engine 4 of the power unit 3.

Moreover, with a simple configuration in which the partitioning member 71 formed of a flat plate is disposed, the breather chamber 7 can be formed between the cam chain chamber cover 49 and the partitioning member 71. Thus, the cam chain chamber 63R in which oil is scattered can be divided from the breather chamber 7. Further, since the partitioning member 71 is formed of a flat plate, an increase in the size of the internal combustion engine 4 with respect to the direction of the crankshaft 31 can be suppressed.

It should be noted that in the present embodiment, the partitioning member 71 is attached to the cam chain chamber cover 49 by screwing, from the rear, partitioning member fastening bolts 71*a* into partitioning member fastening bosses 49*c* (see FIG. 5) provided upright on the inner surface 49*g* of the cam chain chamber cover 49 toward the rear. However, the partitioning member 71 may be attached to the opening circumferential wall 48*a* such that when the cam chain chamber cover 49 is fastened to the opening circumferential wall 48*a*, the partitioning member 71 and the cam chain chamber cover 49 are fastened together.

In FIG. 3, a breather outlet flow path 72 is provided which also serves as a downstream-side portion of the breather chamber 7. An upstream side of the breather outlet flow path 72 is opened at a front end of the opening circumferential wall 48*a* to communicate with a breather chamber outlet 7*b* provided in an upper portion of the cam chain chamber 63R with a downstream side thereof extending in the cylinder block portion 46R to the rear to communicate with an outlet nozzle 73 directed outward. The outlet nozzle 73 communicates with an unillustrated air cleaner through an unillustrated breather return pipe.

FIG. 4 shows a front surface around the cam chain chamber opening 48 with the cam chain chamber cover 49 in FIG. 2 removed as seen from arrows IV-IV of FIG. 3. It should be noted that the partitioning member 71 is shown at a predetermined position.

The partitioning member 71 is located ahead of the right cam chain 65R (on a front side in the drawing) in the right cam chain chamber 63R to be in contact with the inner circumference of the opening circumferential wall 48*a* of the cam chain chamber opening 48 on the right crankcase front wall 42Ra side and with the circumference of the crankshaft 31. In other words, the partitioning member 71 is disposed on the front side of the plane P formed by the rotation locus L of the right cam chain 65R in the direction of the crankshaft 31, and divides the breather chamber 7 from the right cam chain chamber 63R.

As shown in FIG. 4, the breather chamber outlet 7*b*, communicating with the breather outlet flow path 72 located in an upper portion of the right cam chain chamber 63R, is provided in the opening circumferential wall 48*a* and is formed in a right upper portion (left upper portion in the drawing) of the breather chamber 7.

In FIG. 4, partitioning member fastening holes 71*b* allow the partitioning member fastening bolts 71*a* for fastening the partitioning member 71 to be inserted through the partitioning member fastening bosses 49*c* provided upright on the inner surface 49*g* of the aforementioned cam chain chamber cover 49 in FIG. 3 toward the rear.

Moreover, a top surface 48*aa*, straddling the left and right crankcase front walls 42La and 42Ra, of the opening circumferential wall 48*a* of the cam chain chamber opening 48 serves as a mating surface to which the cam chain chamber cover 49 is fastened. The cover fastening bolts 49*b* (see FIG. 3) screwed into the cam chain chamber cover 49 from the front portion side (on a front side in the drawing) are indicated by two-dot chain lines in FIG. 4.

Figure 5:
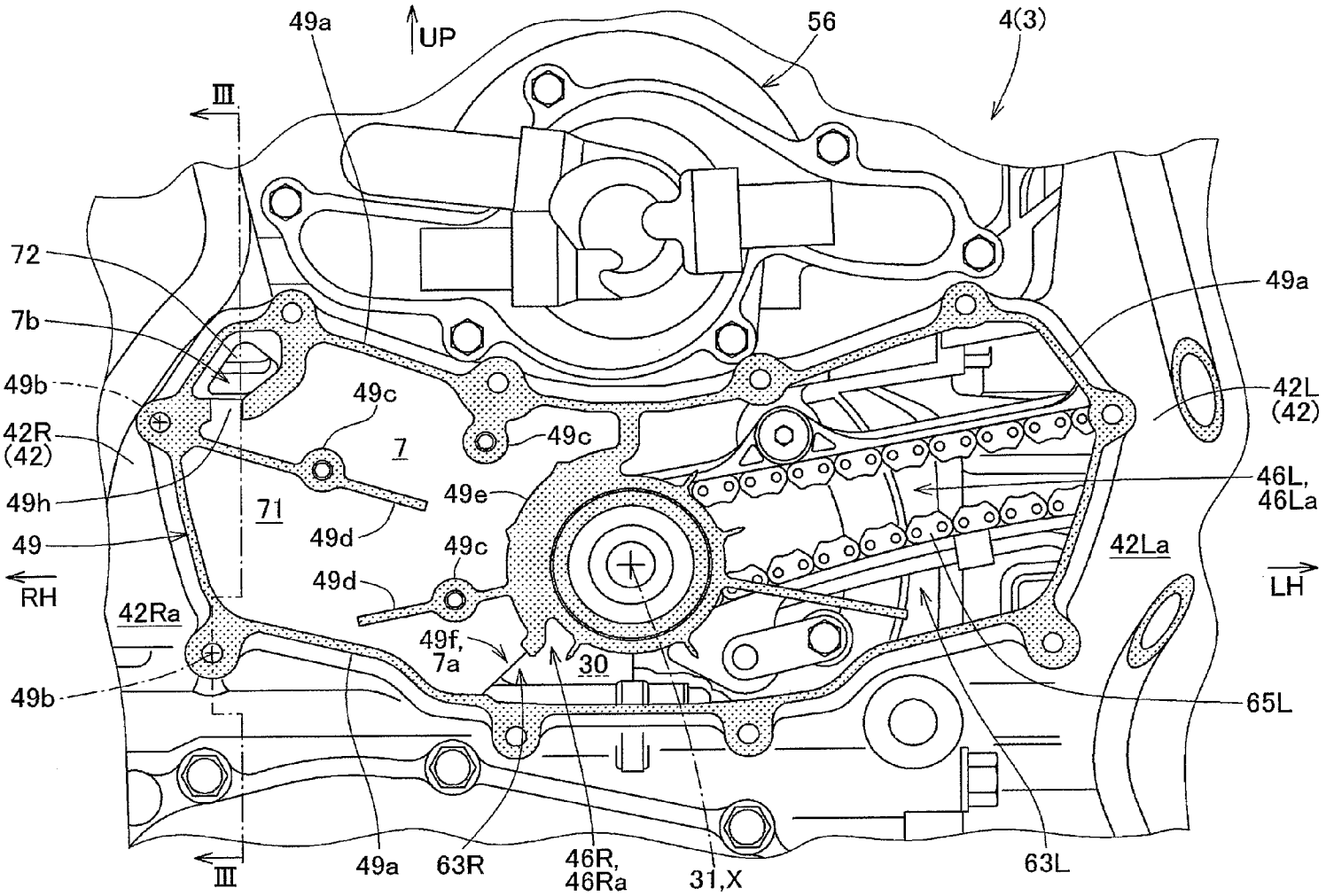
FIG. 5 is a front view of a portion around the opening of the cam chain chamber as seen from arrows V-V of FIG. 3.

FIG. 5 is a front view around the cam chain chamber opening 48*a* in FIG. 2 as seen from arrows V-V of FIG. 3, with the cam chain chamber cover 49 being cut. The cover circumferential wall 49*a* provided on the outer circumference of the cam chain chamber cover 49, the partitioning member fastening bosses 49*c* provided to protrude from the inner surface 49*g*, ribs 49*d*, and a crankshaft circumferential wall 49*e* surrounding the crankshaft 31 are shown as a cross section perpendicular to the axis X of the crankshaft 31.

The breather chamber 7 is surrounded by the cover circumferential wall 49*a* and the crankshaft circumferential wall 49*e* to be demarcated between the partitioning member 71 and the inner surface 49*g* of the cam chain chamber cover 49. A gap 49*f* is provided between the cover circumferential wall 49*a* and the crankshaft circumferential wall 49*e* so that the breather chamber 7 may communicate with the cam chain chamber opening 48 in a lower portion of the cam chain chamber 63R, and constitutes a breather chamber inlet ("inlet" in the present invention) 7*a*.

Moreover, in a right upper portion (left upper portion in the drawing) of the cover circumferential wall 49*a*, the breather chamber outlet ("outlet" in the present invention) 7*b* overlapping an upstream end of the breather outlet flow path 72 is provided in the opening circumferential wall 48*a* and a passage 49*h* (see FIG. 3) for allowing the inside of the breather chamber 7 to communicate with the breather chamber outlet 7*b* are formed.

Accordingly, breather gas flows into the breather chamber inlet 7*a* from the crank chamber 30 side through the left and right cam chain chambers 63L and 63R and the cam chain chamber opening 48*a*. Breather gas from the breather chamber 7 flows out from the breather chamber outlet 7*b* into the breather outlet flow path 72, and is further sent from the outlet nozzle 73 through the unillustrated breather return pipe to the unillustrated air cleaner.

It should be noted that the breather chamber inlet 7*a* is located in lower portions of the left and right cam chain chambers 63L and 63R and that the breather chamber outlet 7*b* is located in an upper portion of the right cam chain chamber 63R. Accordingly, breather gas flowing in through the breather chamber inlet 7*a* flows toward the breather chamber outlet 7*b* in the breather chamber 7 as a rising stream. Accordingly, oil in liquid phase mixed in the breather gas is easily separated downwardly from the gas by the difference in weight between the oil and the gas. Further, oil flowing downwardly from the breather chamber inlet 7*a* located at a lower position flows through the cam chain chambers 63L and 63R into the oil pan portion 47 (see FIG. 2) demarcated below the crank chamber 30.

Thus, a layout which allows oil in the breather gas to be easily discharged from the breather chamber 7 is obtained by providing the breather chamber 7 over the entire height of the cam chain chamber opening 48 using the vertical heights of the cam chain chambers 63L and 63R.

Moreover, as shown in FIG. 5, each of the ribs 49*d* (see FIG. 3) protruding from the inner surface 49*g* of the cam chain chamber cover 49 into the breather chamber 7 is formed to be inclined downwardly from an end connected to the opening circumferential wall 48*a* or the crankshaft circumferential wall 49*e* to an open end in the breather chamber 7 along the inner surface 49*g* of the cam chain chamber cover 49, as seen from the front surface.

Accordingly, while flowing toward the breather chamber outlet 7*b* in the breather chamber 7 as a rising stream, breather gas flowing in through the breather chamber inlet 7*a* passes through a labyrinthine flow path formed by the ribs 49*d* extending from the opening circumferential wall 48*a* and the crankshaft circumferential wall 49*e*. This facilitates the separation of oil from breather gas. Oil separated from breather gas to adhere to the ribs 49*d* flows downwardly toward the open ends of the ribs 49*d*. Thus, oil is easily discharged from the breather chamber 7.

Hereinafter, characteristic configurations and advantageous effects of the breather chamber 7 of the internal combustion engine 4 of the present embodiment will be described together.

More specifically, in the breather chamber 7 of the internal combustion engine 4 including the left and right looped cam chains 65L and 65R for transmitting the power of the horizontally disposed crankshaft 31 to the camshafts 61L and 61R provided in the left and right cylinder heads 43L and 43R and including the left and right cam chain chambers 63L and 63R disposed along the front side portions 46La and 46Ra of the left and right cylinder block portions 46L and 46R which intersect the direction of the crankshaft 31, the breather chamber 7 is disposed on the front side of the plane P formed by the rotation locus L of the right cam chain 65R in the direction of the crankshaft 31 in the right cam chain chamber 63R.

Accordingly, since a large-area space located on the front side of the plane P formed by the rotation locus L of the cam chain 65R in the direction of the crankshaft 31 is utilized to provide the breather chamber 7, the breather chamber 7 having a large size can be formed while an increase in the size of the internal combustion engine 4 is suppressed.

Moreover, the left and right cam chain chambers 63L and 63R are formed by attaching the cam chain chamber cover 49 to the front side portions 46La and 46Ra of the left and right cylinder block portions 46L and 46R. The partitioning member 71 for dividing the breather chamber 7 from the right cam chain chamber 63R is formed of a flat plate and attached to the inside of the cam chain chamber cover 49.

Accordingly, with a simple configuration, the breather chamber 7 can be formed between the cam chain chamber cover 49 and the partitioning member 71. Thus, the cam chain chambers 63L and 63R in which oil is scattered can be divided from the breather chamber 7. Further, since the partitioning member 71 is formed of a flat plate, an increase in the size of the internal combustion engine 4 with respect to the direction of the crankshaft 31 can be suppressed.

Moreover, the breather chamber 7 has the breather chamber inlet 7*a* provided in a lower portion of the right cam chain chamber 63R and the breather chamber outlet 7*b* provided in an upper portion of the right cam chain chamber 63R. Thus, a layout which allows oil to be easily discharged from the breather chamber 7 is obtained using the vertical height of the cam chain chamber 63R.

Moreover, the ribs 49*d* protruding from the cam chain chamber cover 49 into the breather chamber 7 are formed downwardly along the inner surface of the cam chain chamber cover 49 between the breather chamber inlet 7*a* and the breather chamber outlet 7*b*. Accordingly, oil separated from breather gas to adhere to the ribs 49*d* is caused to flow downwardly. Thus, oil is easily discharged from the breather chamber 7.

Moreover, the internal combustion engine 4 is an in-vehicle engine, the crankshaft 31 is directed in the longitudinal direction of the vehicle, the left and right cam chain chambers 63L and 63R are disposed on the front surface of the internal combustion engine 4, and the breather chamber 7 is formed by partitioning the front portion of the right cam chain chamber 63R. Accordingly, even in the case where the internal combustion engine 4 with the crankshaft 31 directed in the longitudinal direction of the vehicle is mounted on a vehicle having space limitations with respect to the longitudinal direction thereof, partitioning a front-side space of the right cam chain chamber 63R with respect to the direction of the crankshaft 31 suppresses an increase in the size of the internal combustion engine 4 with respect to the longitudinal direction of the vehicle while achieving a large volume of the breather chamber 7, and facilitates the installation of the power unit 3 including the internal combustion engine 4.

While one embodiment of the present invention has been described above, it is a matter of course that aspects of the present invention are not limited to the above-described embodiment, and include various aspects for carrying out the invention within the scope of the spirit of the present invention.

For example, the internal combustion engine of the power unit is not limited to the horizontally-opposed, six-cylinder internal combustion engine of the embodiment. Moreover, the internal combustion engine is not limited to an in-vehicle engine, and, if the internal combustion engine is an in-vehicle engine, the crankshaft is not limited to the crankshaft directed in the longitudinal direction of the vehicle.

It should be noted that in the embodiment, left and right in the above description of the configurations and arrangements of components of the power unit, the internal combustion engine, and the breather chamber are specified to be left and right in the drawing for convenience of explanation. However, in the present invention, left and right may be reversed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A breather chamber of an internal combustion engine comprising:

a looped cam chain for transmitting power of a horizontally disposed crankshaft to a camshaft provided in a cylinder head; and a cam chain chamber disposed along a side portion of a cylinder block portion, the side portion intersecting a direction of the crankshaft;

wherein the breather chamber is located on a side of a plane formed by a rotation locus of the cam chain in the forward direction of the crankshaft in the cam chain chamber, wherein the cam chain chamber is formed by attaching a cam chain chamber cover to the side portion of the cylinder block portion, and a partitioning member for dividing the breather chamber from the cam chain chamber is formed of a flat plate and attached to an inside of the cam chain chamber cover, wherein the breather chamber has an inlet provided nearly in a center in the vehicle width direction and a lower portion of the cam chain chamber and an outlet provided nearly in a left and right side in the vehicle width direction and in an upper portion of the cam chain chamber, wherein the internal combustion engine is an in-vehicle engine, the crankshaft is directed in a longitudinal direction of a vehicle, the cam chain chamber is disposed on a front surface of the internal combustion engine, and a front portion of the cam chain chamber is divided to form the breather chamber, wherein the breather chamber is surrounded by a cover circumferential wall and a crankshaft circumferential wall and formed between the partitioning member and an inner surface of the cam chain chamber cover, wherein the crank shaft is arranged in the center in the width direction of the cam chain cover in the front view, and wherein the cam chain cover is upwardly and outwardly inclined from the center in the vehicle width direction to both left and right sides in the vehicle width direction.

2. The breather chamber according to claim 1, wherein the breather chamber has an inlet provided in a lower portion of the cam chain chamber and an outlet provided in an upper portion of the cam chain chamber.

3. The breather chamber according to claim 1, wherein a rib protruding from the cam chain chamber cover into the breather chamber is formed downwardly along an inner surface of the cam chain chamber cover between the inlet and the outlet.

4. The breather chamber according to claim 2, wherein a rib protruding from the cam chain chamber cover into the breather chamber is formed downwardly along an inner surface of the cam chain chamber cover between the inlet and the outlet.

5. A breather chamber of an internal combustion engine comprising:

a left cylinder head and a right cylinder head;

a left camshaft operatively provided in the left cylinder head and a right camshaft operatively provided in the right cylinder head;

a crankshaft;

a looped cam chain for transmitting power from the crankshaft to the left camshaft and the right camshaft; and a cam chain chamber disposed along a side portion of a cylinder block portion, the side portion intersecting a direction of the crankshaft;

wherein the breather chamber is located on a side of a plane formed by a rotation locus of the cam chain in the forward direction of the crankshaft in the cam chain chamber, wherein the cam chain chamber is formed by attaching a cam chain chamber cover to the side portion of the cylinder block portion, and a partitioning member for dividing the breather chamber from the cam chain chamber is formed of a flat plate and attached to an inside of the cam chain chamber cover, wherein the breather chamber has an inlet provided nearly in a center in the vehicle width direction and in a lower portion of the cam chain chamber and an outlet provided nearly in a left and right side in the width direction and in an upper portion of the cam chain chamber, wherein the internal combustion engine is an in-vehicle engine, the crankshaft is directed in a longitudinal direction of a vehicle, the cam chain chamber is disposed on a front surface of the internal combustion engine, and a front portion of the cam chain chamber is divided to form the breather chamber, wherein the breather chamber is surrounded by a cover circumferential wall and a crankshaft circumferential wall and formed between the partitioning member and an inner surface of the cam chain chamber cover, wherein the crank shaft is arranged in the center in the width direction of the cam chain cover in the front view, and wherein the cam chain cover is upwardly and outwardly inclined from the center in the vehicle width direction to both left and right sides in the vehicle width direction.

6. The breather chamber according to claim 5, wherein the breather chamber has an inlet provided in a lower portion of the cam chain chamber and an outlet provided in an upper portion of the cam chain chamber.

7. The breather chamber according to claim 5, wherein a rib protruding from the cam chain chamber cover into the breather chamber is formed downwardly along an inner surface of the cam chain chamber cover between the inlet and the outlet.

8. The breather chamber according to claim 6, wherein a rib protruding from the cam chain chamber cover into the breather chamber is formed downwardly along an inner surface of the cam chain chamber cover between the inlet and the outlet.

* * * * *